US005953026A

United States Patent [19]

Yoshino

[11] Patent Number: 5,953,026

[45] **Date of Patent: *Sep. 14, 1999**

[54] INK JET PRINTING APPARATUS, METHOD OF DISPOSING WASTE LIQUIDS AND APPARATUS THEREFOR

[75] Inventor: Hiroshi Yoshino, Yokohama, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/599,756

[22] Filed: Feb. 12, 1996

[30] Foreign Application Priority Data

Feb. 13, 1995 [JP] Japan ..... 7-023585

[51] Int. Cl.[6] ..... B41J 2/165

[52] U.S. Cl. ..... 347/36

[58] Field of Search ..... 347/20, 22, 36

[56] References Cited

U.S. PATENT DOCUMENTS

| | | | |
|---|---|---|---|
| 4,383,263 | 5/1983 | Ozawa et al. | 347/30 |
| 4,437,104 | 3/1984 | Hudson | 346/140 R |
| 4,538,160 | 8/1985 | Uchiyama | 346/140 R |
| 4,695,824 | 9/1987 | Tazaki | 347/86 |
| 4,901,094 | 2/1990 | Iwagami et al. | 346/140 R |
| 4,965,596 | 10/1990 | Nagoshi et al. | 347/36 |
| 5,157,421 | 10/1992 | Kitahara | 346/140 R |
| 5,172,140 | 12/1992 | Hirabayashi et al. | 347/36 |
| 5,237,341 | 8/1993 | Iwagami et al. | 346/140 R |
| 5,579,038 | 11/1996 | Kimura | 347/36 |
| 5,617,124 | 4/1997 | Taylor et al. | 347/35 |
| 5,618,338 | 4/1997 | Kurabayashi et al. | 106/26 R |
| 5,635,969 | 6/1997 | Allen | 347/96 |
| 5,640,187 | 6/1997 | Kashiwazaki et al. | 347/101 |
| 5,680,162 | 10/1997 | Taylor | 347/35 |

FOREIGN PATENT DOCUMENTS

| | | |
|---|---|---|
| 323262 | 7/1989 | European Pat. Off. . |
| 581135 | 2/1994 | European Pat. Off. . |
| 585923 | 3/1994 | European Pat. Off. . |
| 57-22065 | 2/1982 | Japan . |
| 61-24457 | 2/1986 | Japan . |
| 1-63185 | 3/1989 | Japan . |
| 1-184146 | 7/1989 | Japan . |

*Primary Examiner*—Adolf Deneke Berhane
*Attorney, Agent, or Firm*—Fitzpatrick, Cella, Harper & Scinto

[57] ABSTRACT

An ink jet apparatus includes a first ejecting portion for ejecting a treatment liquid having a function of insolubilizing or agglomerating an ink and a second ejecting portion for ejecting the ink, in which apparatus a waste liquid of the treatment liquid and a waste liquid of the ink are mixed so that the mixture is insolubilized or agglomerated and is stored within the apparatus. Cap units for recovering heads, which eject ink or treatment liquid having a function of insolubilizing or agglomerating the ink, contact the heads to cap the heads when a carriage is at the home position in order to prevent the ink and treatment liquid from evaporating. The ink and treatment liquid in the heads, which are sucked upon recovering treatment, are transferred from pump units to a waste liquid storing portion by means of tubes. The ink and treatment liquid discharged from the heads upon recovering are transferred via the tubes on an inclined bottom surface of the waste liquid storing portion in which they are mixed and stored in an insolubilized or agglomerated state.

24 Claims, 10 Drawing Sheets

INK JET PRINTING APPARATUS, METHOD OF DISPOSING WASTE LIQUIDS AND APPARATUS THEREFOR

BACKGROUND OF THE INVENTION

1. Field of the Invention

The present invention relates generally to an ink jet apparatus and a waste liquid absorbing method each of which assures that an image having a high quality can be obtained on a printing medium. More particularly, the present invention relates to an ink jet apparatus for ejecting on the printing medium liquid having a function of insolubilizing a coloring material in ink prior to ejection of the ink.

The present invention is applicable to all kinds of instruments for which a printing medium such as a sheet of paper, unwoven fabric, a sheet of OHP film or the like is used. The applicable instrument is typically exemplified by an office machine and a mass production machine such as a printer, a copying machine, a facsimile or the like.

2. Description of Related Art

An ink jet printing method is utilized for a printer, a copying machine, a facsimile or the like since a low level of noisy sound is generated, the ink jet method is practiced at a low running cost, an apparatus is easily designed with small dimensions, and an image is easily formed by using colored inks.

However, the ink jet printing system has the following specific problems to be solved.

(1) Since a printing operation is performed by ejecting ink droplets from an ink jet head to a sheet of paper, a sheet of OHP film or a similar printing medium, fine ink mist other than the ejected main ink droplets or ink mist ejected to the printing medium rebounds to an ink jet head, causing the ink mist to adhere to an ink ejecting port surface until a large quantity of ink mist get together around the ink ejecting port. In addition, when paper powder or a similar foreign material adheres to the fine mist, ink ejection is obstructed, causing ink droplets to be ejected in an unexpected direction. In an extreme case, ink droplets can not be ejected.

(2) Unless the ink jet head is continuously ejected for a long time inclusive of non-printing time, ink in the nozzle is dried due to vaporization, resulting in the nozzle being clogged with ink having increased viscosity or solidified ink. Thus, there arises a malfunction that ink is ejected in the warped state or no ink ejection is effected.

The ink jet apparatus is generally equipped with recovering means as means for solving the problems as mentioned in the paragraph (1) and the paragraph (2) above. Specifically, when no printing operation is performed, an ink jet head is capped with capping means for the purpose of preventing ink in a nozzle of the ink jet head from being vaporized and dried, resulting in the ink having increased viscosity or adherence to the nozzle. In the case that incorrect ejection is effected due to increased viscosity or adherence, foreign material which cannot be removed by a blade adhere to the ink ejecting port surface, ink having increased viscosity in the nozzle is discharged by operating a suction pump connected to the cap so as to conduct recovering treatment for recovering normal ejection. Here, the discharged ink is sucked in a waste ink absorbing substance disposed in a housing of the apparatus via piping extending downstream of the suction pump.

The capacity of the waste ink absorbing substance is determined depending on the number of times of incorrect printings, the number of times of recovering operations, a quantity of ink squeezed or sucked every recovering operation or a quantity of ink mist discharged from the ink jet head, it is recommendable from the viewpoint of the layout or design of the whole structure of the apparatus that the waste ink absorbing substance is compactly designed to have a small capacity because it is expected that the position where it is to be disposed is not restricted, and moreover, it is fabricated at a low cost. However, if the capacity of the waste ink absorbing substance is set to a quantity originally required by the apparatus, there arises an inconvenience of maintenance that the waste ink absorbing substance must be periodically replaced with a new one. On the contrary, when a waste ink absorbing substance having a required capacity is disposed on the apparatus, the waste ink absorbing substance is relatively enlarged, causing it to be fabricated at an increased cost, and moreover, the housing of the apparatus is enlarged in size. In this connection, a technology for minimizing a volume of the waste ink absorbing substance by utilizing vaporization of ink is disclosed on an official gazette of Japanese Patent Application Laid-Open No. 22065/1982.

On the other hand, in the case that an image has insufficient water resistibility or a color image is formed on a printing medium that is called a plain paper with the aforementioned apparatus having an ink jet printing method applied thereto, a request for an image having a high density without an occurrence of feathering and a request for an image having no oozing of coloring substance among colors cannot exist together, resulting in a quality of colored image being remarkably degraded.

In recent years, as a method of improving water resistibility of an image, ink containing a coloring material having resistibility against water has been put in practical use. However, since this ink still has an insufficient water resistibility, and it is ink which is theoretically hardly soluble in water after drying, it has a drawback that ink is liable to cause a failure of ink ejection.

In view of the foregoing fact, Japanese Patent Application Laid-Open No. 63185/1989 discloses the technology in which transparent or translucent treatment liquid containing a coloring substance which is insoluble in a solvent is caused to adhere to a printing medium with the aid of an ink jet head directly before a printing operation is performed. However, with respect to this technology, the problem specific to the ink jet apparatus is also arises to a head for ejecting the treatment liquid, and when the treatment liquid is not ejected from the nozzle as a result of failure of ejection, it occurs sometimes that the water resistibility and quality of the portion of images which is affected by the failure of ejection of the treatment liquid are remarkably degraded. For this reason, it is necessary that the head for the treatment liquid is equipped with recovering means similar to that used in the ink jet head.

FIG. 1 schematically shows by way of example the structure of a conventional ink jet apparatus which is equipped not only with recovering means for recovering an ink jet head but also with recovering means for recovering a head for ejecting treatment liquid. Here, each of a plurality of ink jet cartridges 1 includes an ink tank portion. A plurality of ink jet cartridges 1, each containing treatment liquid for insolubilizing coloring ink and coloring material for printing, are mounted on a carriage 3 at predetermined positions. The carriage 3 is slidably supported on a shaft 4 extending in the main scanning direction, and a driving belt 5 serves to transmit the driving force of a driving motor 6 for reciprocatingly displacing the carriage 3 along the axis of the shaft 4. A printing medium 11 is conveyed while its printing surface is flatly restricted by a platen 12. At this time, ink jet head portions 2 of the ink jet cartridges 1 mounted on the carriage 3 is projected downward of the carriage 3 to assume a position between two sets of conveying rollers (not shown) of the printing medium 11, and ink ejecting port forming surfaces of the ink jet head portions 2 faces to the printing medium 11 which is located in parallel thereto while comes in pressure contact with the guide surface of the platen 12.

In addition, a recovering system unit 20 is arranged on the home position side located on the right-hand side in FIG. 1. The recovering system unit 20 has a plurality of cap units 21 corresponding to the respective ink jet head portions 2 of a plurality of ink jet cartridges 1. The cap units 21 can be raised and lowered in the vertical direction. When the carriage 3 is located at the home position, it is connected to the ink jet head portions 2 so as to cap the latter therewith to prevent an occurrence of incorrect ejection due to increased viscosity or chemical fixing induced by evaporation (vaporization) of ink in the ink ejection port. A pump unit (not shown) is disposed in the recovering system unit 20. This pump unit serves to generate negative pressure when suction recovering treatment is conducted by connecting the cap unit 21 to the ink jet head portions 2. As the suction recovering treatment is conducted, the ink and the treatment liquid sucked from the ink jet head is absorbed in a waste liquid absorbing substance 23 via a tube 22 by driving the pump unit.

When suction recovering treatment is conducted with the ink jet apparatus as mentioned above, two kinds of materials, i.e., the treatment liquid and ink are present in the waste liquid absorbed in the waste liquid absorbing substance 23. However, although these two kinds of waste liquids are fluid per se, they will have an increased viscosity when they are mixed with each other. Thus, there arise the following problems.

(1) When both liquids are absorbed in a waste liquid absorbing substance, they contact with each other to form a waste mixed liquid, whose viscosity increases, so that the mixed liquid accumulates on the waste liquid absorbing substance. Therefore, it is difficult for the waste liquid absorbing substance to absorb the waste mixed liquid fully.

(2) If the height of the space for storing the waste ink is to be enlarged taking into consideration accumulation of the insolubilized waste mixed liquid, the entire height of the ink jet apparatus becomes too high to be practically acceptable (3) A possible countermeasure for avoiding the accumulation of would be to provide two separate recovering systems one for recovering the treatment liquid and the other for ink, and also provide waste liquid absorbing substances separately for ink and treatment liquid so as to avoid increased viscosity of the waste liquid. However, this solution is accompanied by a considerable increase in cost and by enlargement in size of the ink jet apparatus.

SUMMARY OF THE INVENTION

An object of the present invention is to provide an ink jet apparatus which obviates the drawbacks inherent to the prior art and realizes an ink jet apparatus which ejects ink and treatment liquid on a printing medium to form images and permits efficient disposal of waste liquids without resorting to waste liquid absorbing substances in the waste liquid storing space to thereby reduce cost and size of the apparatus.

According to a first aspect of the present invention, there is provided an ink jet apparatus comprising:

a first ejecting portion for ejecting a treatment liquid having a function of insolubilizing or agglomerating the ink;

a second ejecting portion for ejecting an ink;

first recovering means for recovering nozzles of aid first ejecting portion;

second recovering means for recovering nozzles of the second ejecting portion;

waste liquid storing means for storing waste liquids discharged from the first and second recovering means;

first transfer means for transferring the waste liquid discharged from the first recovering means to the waste liquid storing means, the first transfer means having a discharge end for discharging the waste liquid from the first recovering means;

second transfer means for transferring the waste liquid discharged from the second recovering means to the waste liquid storing means, the first transfer means having a discharge end for discharging the waste liquid from the second recovering means;

wherein the waste liquid storing means has an inner bottom surface, the inner bottom surface arranged descending in vertical direction from a position in which the discharge ends of the first and second waste liquid transferring means, respectively, are located toward positions remote from the position in which the discharge ends are located.

Here, the second ejecting portion may comprise a plurality of ejecting portions.

The ink jet apparatus may further comprise means for generating thermal energy for ejecting an ink or treatment liquid.

The treatment liquid may contain a cationic material composed of a low molecular weight ingredient and a high molecular weight ingredient, and the ink may contain an anionic dye.

The treatment liquid may contain a cationic material composed of a low molecular weight ingredient and a high molecular weight ingredient, and the ink may contain an anionic dye or at least an anionic compound and a pigment.

According a second aspect of the present invention, there is provided an ink jet apparatus comprising:

a first ejecting portion for ejecting a treatment liquid having a function of insolubilizing or agglomerating an ink;

a second ejecting portion for ejecting the ink;

a framework for storing therein a waste liquid of the treatment liquid and a waste liquid of the ink;

a cap for sucking the first ejecting portion, the cap contacting the first ejecting portion;

a first suction pump for sucking a liquid in the first ejecting portion through the cap for sucking the first ejecting portion;

a first tube for introducing the waste liquid discharged from the first suction pump to the framework for storing the waste liquid discharged from the first suction pump;

a first groove for flowing the waste liquid discharged from the first tube;

a cap for sucking the second ejecting portion, the cap contacting the second ejecting portion;

a second suction pump for sucking a liquid in the second ejecting portion through the cap for sucking the second ejecting portion;

a second tube for introducing the waste liquid discharged from the second suction pump to the framework for storing the waste liquid discharged from the second suction pump;

a second groove for flowing the waste liquid discharged from the second tube;

wherein the waste liquid storing framework has a bottom surface being inclined in the direction in which waste liquid-is discharged, the first and second grooves being arranged in the bottom surface of the waste liquid storing framework parallel to each other in a juxtaposed state, the first and second grooves having respective ends joining with each other.

Here, the second ejecting portion may comprise a plurality of ejecting portions.

The ink jet head may include as an energy generating element an eletrothermal transducer for generating thermal energy so as to allow a phenomenon of film boiling to appear in ink.

The treatment liquid may contain a cationic material composed of a low molecular weight ingredient and a high molecular weight ingredient, and the ink may contain an anionic dye.

The treatment liquid may contain a cationic material composed of a low molecular weight ingredient and a high molecular weight ingredient, and the ink may contain an anionic dye or at least an anionic compound and a pigment.

According to a third aspect of the present invention, there is provided a method of disposing of a waste liquid in an ink jet apparatus, comprising the steps of:

recovering a first ejecting portion for ejecting a treatment liquid having a function of insolubilizing or agglomerating an ink;

recovering a second ejecting portion for ejecting the ink;

transferring waste liquids discharged from the first and second ejecting portions, respectively, upon the recovering, in an isolated state to a predetermined position in a waste liquid storing region due to gravitation; and mixing the waste liquids of the ink and the treatment liquid in the predetermined position in the waste liquid storing region to insolubilize or agglomerate them.

Here, the second ejecting portion may comprise a plurality of ejecting portions.

According to a fourth aspect of the present invention, there is provided a method of disposing of a waste liquid in an ink jet apparatus, comprising the steps of:

contacting caps with a first ejecting portion for ejecting a treatment liquid having a function of insolubilizing or agglomerating an ink and with a second ejecting portion for ejecting the ink, and then sucking the first and second ejecting portions by means of first and second suction pumps, respectively;

transferring waste liquids discharged from the first and second ejecting portions, respectively, to a predetermined position in a waste liquid storing region by means of first and second tube means, respectively; and flowing the waste liquids of the ink and the treatment liquid discharged from the first and second tube means, respectively, in respective passages substantially parallel to each other in a juxtaposed state along a plane inclined with respect to the direction in which the waste liquids are discharged, and allowing the waste liquids to join at ends of the passages to thereby mix the waste liquids of the treatment liquid and the ink to insolubilize or agglomerate the waste liquids.

Here, the second ejecting portion may comprise a plurality of ejecting portions.

According a fifth aspect of the present invention, there is provided, a method of disposing of waste liquids in an ink jet apparatus including a first ejecting portion for ejecting a treatment liquid having a function of insolubilizing or agglomerating an ink and a second ejecting portion for ejecting the ink, comprising the steps of:

transferring respective waste liquids discharged from the first and second ejecting portions to predetermined position in a waste liquid storing region in an isolated state due to gravitation; and mixing the waste liquid of the treatment liquid and the waste liquid of the ink in the predetermined position in the waste liquid storing region to insolubilize or agglomerate the waste liquids.

Here, the second ejecting portion may comprise a plurality of ejecting portions.

According to a sixth aspect of the present invention, there is provided a method of disposing of waste liquids in an ink jet apparatus including a first ejecting portion for ejecting a treatment liquid having a function of insolubilizing or agglomerating an ink and a second ejecting portion for ejecting the ink, comprising the steps of:

transferring respective waste liquids discharged from the first and second ejecting portions to a waste liquid storing region by means of first and second tubes; and flowing the waste liquids of the ink and the treatment liquid discharged from the first and second tube means, respectively, in respective passages substantially parallel to each other in a juxtaposed state along a plane inclined with respect to the direction in which the waste liquids are discharged, and allowing the waste liquids to join at ends of the passages to thereby mix the waste liquids of the treatment liquid and the ink to insolubilize or agglomerate the waste liquids.

Here, the second ejecting portion may comprise a plurality of ejecting portions.

According to a seventh aspect of the present invention, there is provided, a container for storing waste liquids from an ink jet apparatus including a first ejecting portion for ejecting a treatment liquid having a function of insolubilizing or agglomerating an ink and a second ejecting portion for ejecting the ink, the container comprising:

storing space for storing waste liquids from the first and second ejecting portions upon recovery thereof;

a first transferring passage for transferring the waste liquid of the treatment liquid into the storing space; and a second transferring passage for transferring the waste liquid of the ink into the storing space.

wherein the storing space is defined by an inner bottom surface, the inner bottom surface arranged descending in vertical direction from a position in which the discharge ends of the first and second waste liquid transferring passages, respectively, are located toward positions remote from the position in which the discharge ends are located.

According to an eighth aspect of the present invention, there is provided a container for storing waste liquids from an ink jet apparatus including a first ejecting portion for ejecting a treatment liquid having a function of insolubilizing or agglomerating an ink and a second ejecting portion for ejecting the ink, the container comprising:

a framework for storing space for storing waste liquids of the treatment liquid and the ink, respectively;

a first groove for flowing the waste liquid of the treatment liquid;

a second groove for flowing the waste liquid of the ink;

wherein the framework has an inner bottom surface, the inner bottom surface arranged inclined in the direction in which the waste liquids are discharged, and the first and second grooves are arranged in the inner bottom surface parallel to each other and in a juxtaposed state, with the ends of the first and second grooves joining with each other.

According to a ninth aspect of the present invention, there is provided an apparatus for disposing of waste liquids from an ink jet apparatus including a first ejecting portion for ejecting a treatment liquid having a function of insolubilizing or agglomerating an ink and a second ejecting portion for ejecting the ink, the apparatus comprising:

waste liquid storing means for storing waste liquids of the ink and the treatment liquid, respectively;

first transferring means for transferring the waste liquid of the treatment liquid to the waste liquid storing means;

second transferring means for transferring the waste liquid of the ink to the waste liquid storing means;

wherein the waste liquid storing means has an inner bottom surface, the inner bottom surface arranged inclined in the direction in which the waste liquids are discharged, and the first and second transferring means are arranged in the inner bottom surface parallel to each other and in a juxtaposed state, with the ends of the first and second transferring means joining with each other.

Here, the second ejecting portion may comprise a plurality of ejecting portions.

According to a tenth aspect of the present invention, there is provided an apparatus for disposing of waste liquids from an ink jet apparatus including a first ejecting portion for ejecting a treatment liquid having a function of insolubilizing or agglomerating an ink and a second ejecting portion for ejecting the ink, the apparatus comprising:

a framework for storing waste liquids of the ink and the treatment liquid, respectively;

a first tube for transferring the waste liquid of the treatment liquid to the framework for storing waste liquids;

a first groove for flowing the waste liquid discharged from the first tube;

a second tube for transferring the waste liquid of the ink to the framework for storing waste liquids;

a second groove for flowing the waste liquid discharged from the second tube;

wherein the framework for storing waste liquids has an inner bottom surface, the inner bottom surface arranged inclined in the direction in which the waste liquids are discharged, and the first and second grooves are arranged in the inner bottom surface parallel to each other and in a juxtaposed state, with the ends of the first and second grooves joining with each other.

Here, the second ejecting portion may comprise a plurality of ejecting portions.

The above and other objects, effects, features and advantages of the present invention will become more apparent from the following description of embodiments thereof taken in conjunction with the accompanying drawings.

DESCRIPTION OF THE PREFERRED EMBODIMENTS

Figure 1:
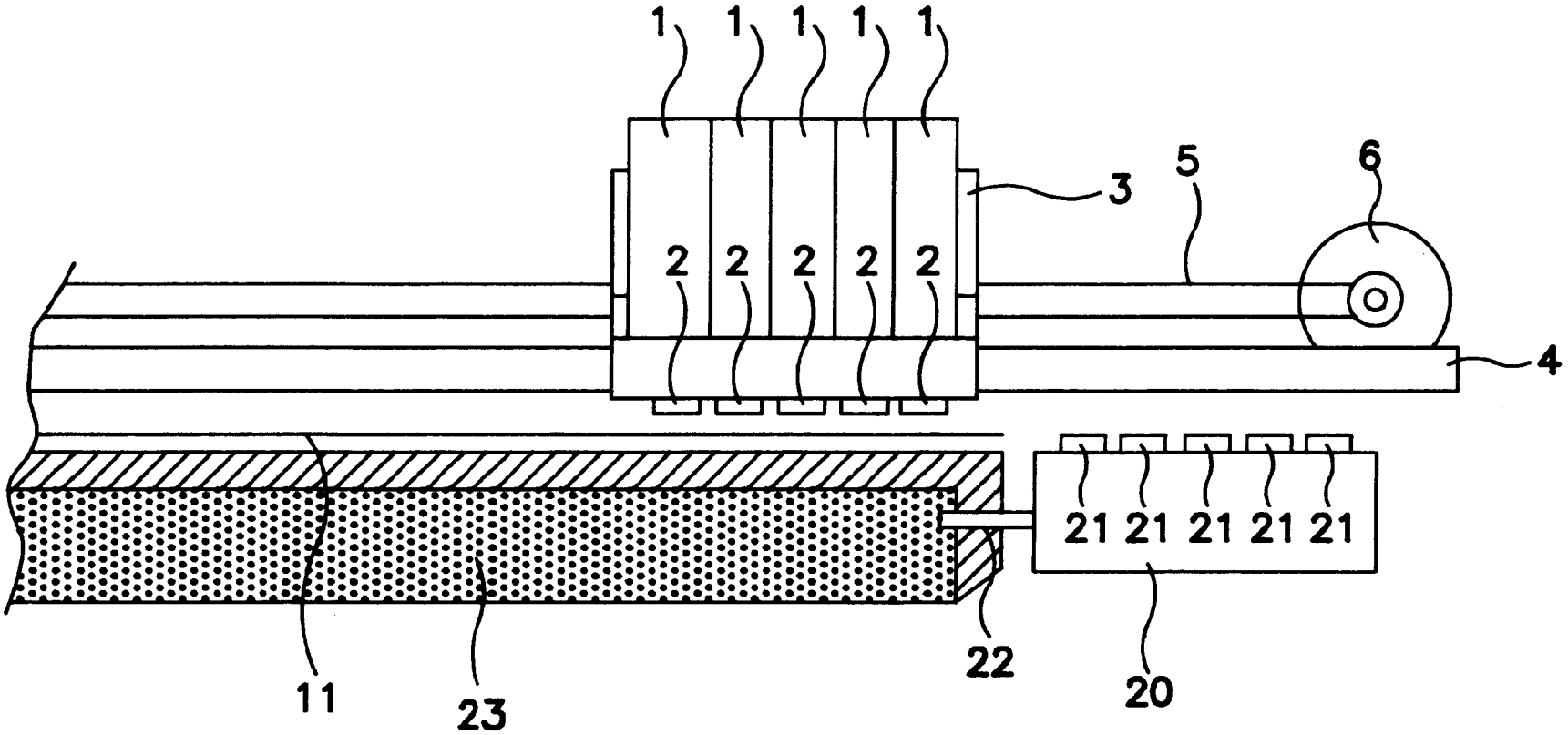
FIG. 1 (PRIOR ART)
FIG. 1 is a front view which schematically show the structure of a conventional ink jet apparatus.

The present invention will be described in detail hereinafter with reference to the accompanying drawings. However, the present invention should not be construed as being limited thereto.

Referring to the drawings, an embodiment of an ink vet printing apparatus according to the present invention will be described specifically.

Figure 2:
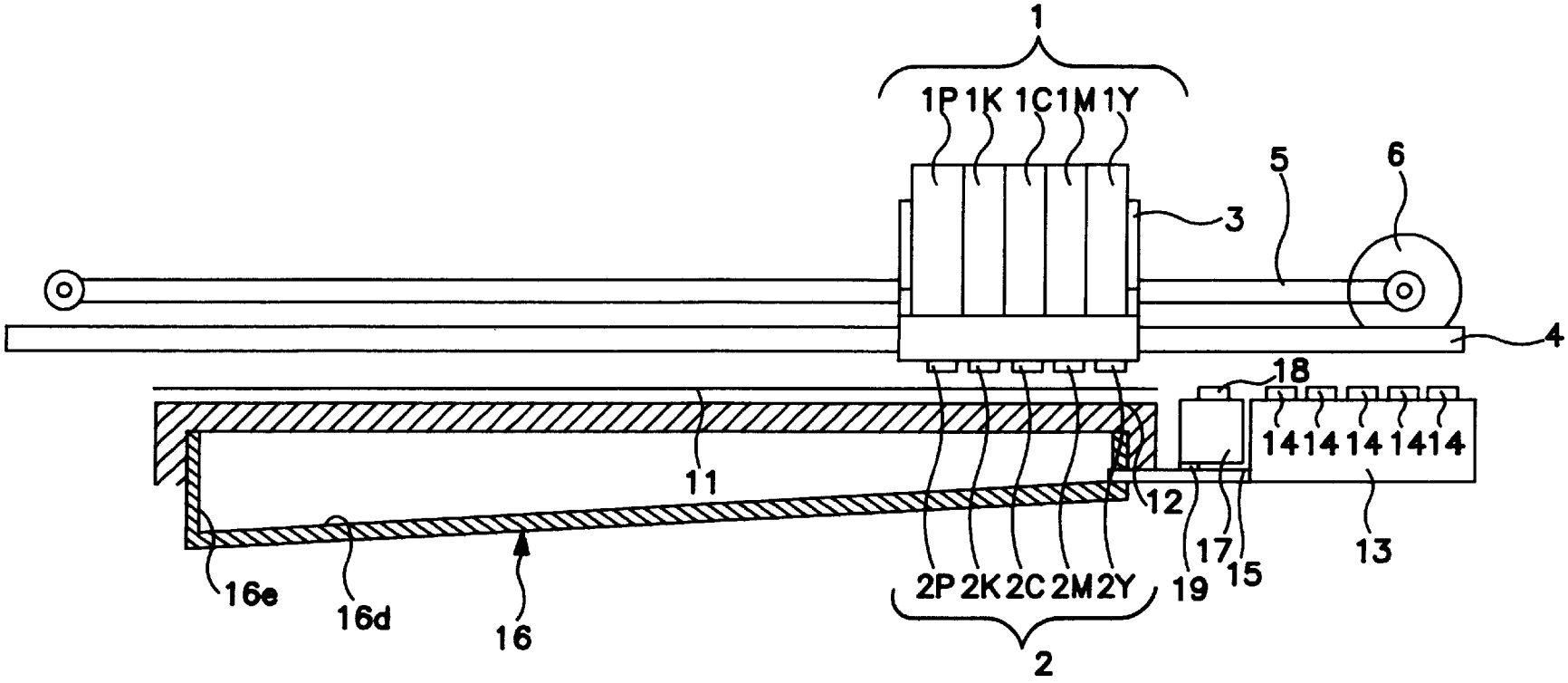
FIG. 2 is a front view which schematically shows the structure of an ink jet apparatus constructed in accordance with the present invention.
Figure 3:
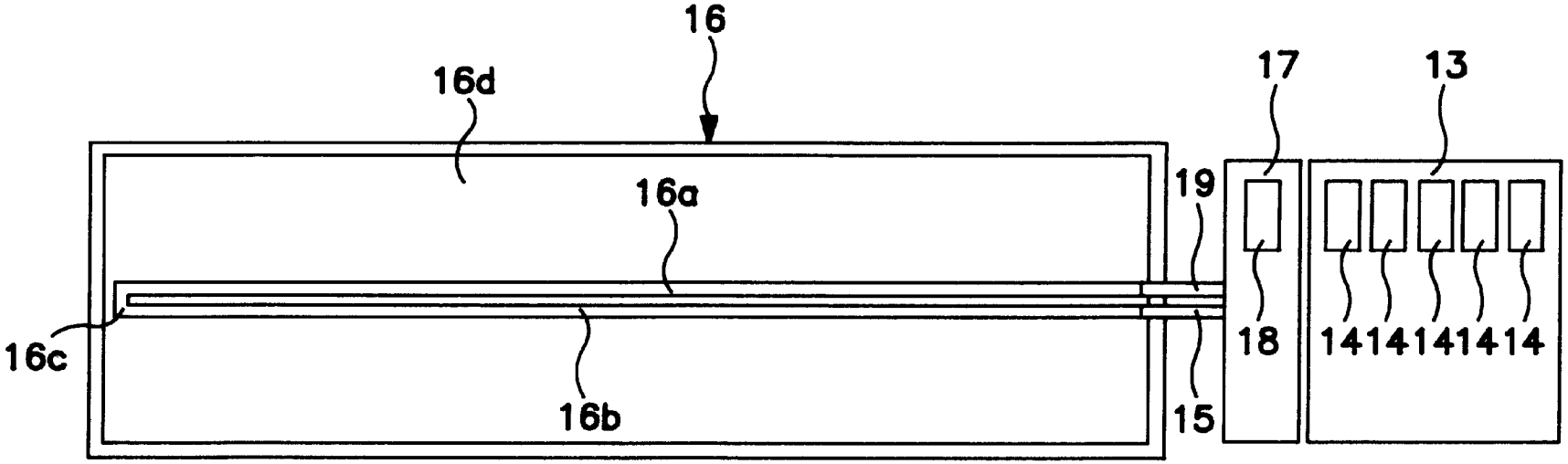
FIG. 3 is a schematic top view of the ink jet apparatus shown in FIG. 2.
Figure 4:
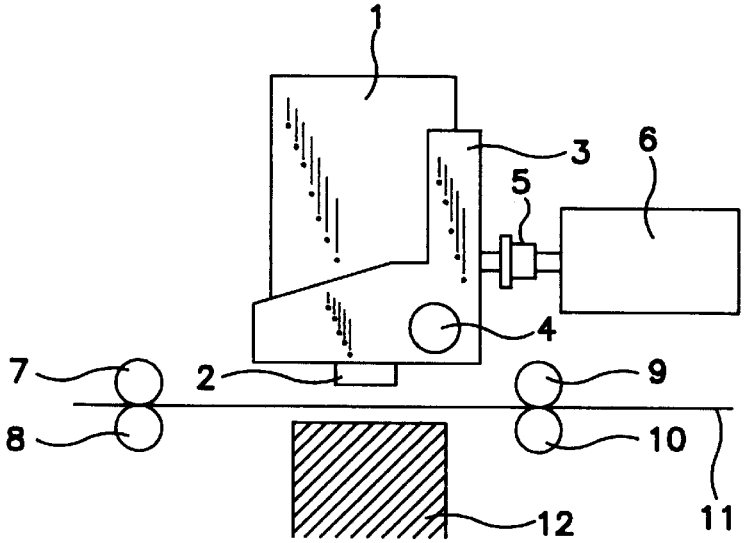
FIG. 4 is a schematic side view of the ink jet apparatus shown in FIG. 2.

FIGS. 2, 3 and 4 show schematic front, top, and side views, respectively, of an ink jet printing apparatus to which the present invention is applied. In the schematic top view shown in FIG. 2, peripheral parts of the carriage and elements or members of a paper conveyance system are omitted.

As shown in FIGS. 2 to 4, a plurality of ink cartridges 1 include each in the respective upper part thereof ink tank portions and in the respective lower part thereof lower ink jet head portions 2 and further include each a connector (not shown) which receives a signal for driving the ink jet head. A carriage 3 carries a plurality of ink jet cartridges 1, which contain different coloring inks of different colors and treatment liquid, e.g., yellow ink, magenta ink, cyan ink, and black ink, and treatment liquid for insolubilizing the coloring materials, in their right positions. The carriage 3 also includes a connector holder (not shown) for transmitting signals for driving an ink jet head and is electrically connected to the ink jet head. In this embodiment, a plurality of cartridges, i.e., a cartridge 1Y containing yellow ink (Y), a cartridge 1M containing magenta ink (M), a cartridge 1C containing cyan ink (C), and a cartridge 1K containing black ink (K), respectively, and a cartridge 1P containing treatment liquid (P) for insolubilizing coloring material, are detachably mounted in position on the carriage 3 in order from the right to the left in FIG. 2. Each head for ejecting ink or treatment liquid is provided with, for example, 160 (hundred and sixty) ejecting ports through which ink or treatment liquid is ejected in amounts of, for example, 40 ng. Each of the tanks, i.e., the ink tanks and treatment liquid tank, is connected to its corresponding head for ejecting ink or treatment liquid by a connecting portion (not shown) so that each tank can supply ink or treatment liquid to its corresponding head. The carriage 3 is slidably supported on a guide shaft 4, which extends in the main scanning direction in which the carriage 3 moves or scans. A driving belt 5 serves to transmit to the carriage 3 driving force from a driving motor 6 so that the carriage 3 can move reciprocatingly along the guide shaft 4. The apparatus includes conveying rollers 7, 8, 9, and 10 for clamping a printing medium 11 while it is being conveyed. That is, two pairs of conveying rollers, a first pair of rollers 7 and 8, and a second pair of rollers 9 and 10 are arranged before and behind the printing position of the ink jet head. The printing medium 11 is conveyed while it is brought in pressure contact with a platen 12 for restricting the printing surface in a flattened state. At this time, the ink jet head portions 2 of the ink jet cartridges 1 mounted on the carriage 3 are projected downward of the carriage 3 and are located between conveying rollers 7 and 9 for conveying the printing medium 11, and ink ejecting port forming surfaces of the ink jet head portions 2 face parallel to the printing medium 11 which is brought in pressure contact with the guide surface of the platen 12.

In the ink jet apparatus constructed in accordance with this embodiment, a recovering system unit 13 is arranged on the home position side located on the right-hand side as seen in FIG. 2. A plurality of cap units 14 are arranged corresponding to the ink jet head portions 2 of the plurality of ink jet cartridges 1, and the cap units 14 can be raised and lowered in the vertical direction. When the carriage 3 is located at the home position, each of the cap units 14 is connected to the ink jet head portions 2 (i.e., 2Y, 2M, 2C, 2K) in order to prevent incorrect ejection due to increased viscosity and evaporation of the ink in an ink ejecting port of the ink jet head In addition, a pump unit (not shown) is disposed in the recovering system unit 13. When the ink jet head performs incorrect ejection, this pump unit induces negative pressure at the time of suction recovering treatment performed while the cap units 14 are connected to the ink jet head portions 2. During such suction recovering treatment, the ink sucked in the ink jet head is transferred from the pump unit (not shown) to a waste liquid storing portion 16 via a tube 15 which serves as waste liquid conveying means for conveying a waste liquid.

On the other hand, a treatment liquid recovering unit 17, which recovers exclusively the cartridge that receives the treatment liquid, is provided on the left-hand side as seen in FIG. 2. The treatment liquid recovering unit 17 has a cap unit 18 thereon corresponding to one of the heads 2, more particularly, the head 2P which ejects treatment liquid. The cap unit 18 can move up and down. When the carriage 3 is in the home position, the cap unit 18 is connected to the head portion 2 for ejecting treatment liquid to cap the head so that the cap unit 18 can prevent the treatment liquid in the ejecting port of the head from evaporating to become more viscous and adhere to the ejecting port, thus avoiding failure of ejection. Also, in the treatment liquid recovering system unit 17 is provided a pump unit (not shown) similar to the recovering system unit 13 so as to conduct suction recovering treatment in the case that the treatment liquid head does not eject the treatment correctly. The treatment liquid discharged from the treatment liquid ejecting head by such recovering treatment is transferred through a tube 19 as transferring means for transferring a waste liquid before the waste treatment liquid is stored in the waste liquid storing portion 16. The treatment liquid recovering system unit 17 inclusive of the pump unit is provided in addition to the recovering system unit 13 is to avoid an occurrence of incorrect suction due to increased viscosity induced by mixing the ink and treatment liquid with each other in the pump.

Further, on the bottom of the waste liquid storing portion are grooves 16*a* and 16*b* for flowing treatment liquid and ink, respectively (FIG. 3). The grooves 16*a* and 16*b* are arranged parallel to each other at a small distance therebetween. They share a tip portion 16*c* arranged at the side opposite to the side where the treatment liquid recovering unit is located so that they communicate with each other through the tip portion 16*c*. An inner bottom surface 16*d* in which the grooves 16*a* and 16*b* are formed is inclined in the direction in which the waste liquid is discharged; the depth of the waste liquid storing portion 16 is the greatest at its left end 16*e* in FIG. 2.

Next, description will be made on the manner in which a waste liquid is stored in this embodiment.

Figure 5:
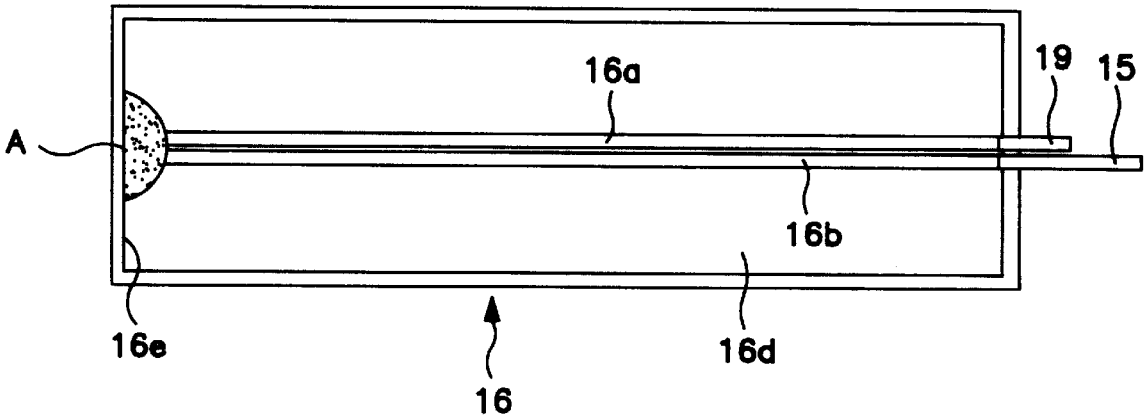
FIG. 5 is a schematic top view showing the waste liquid storing portion in accordance with the present invention at an initial stage of storing waste liquid.
Figure 6:
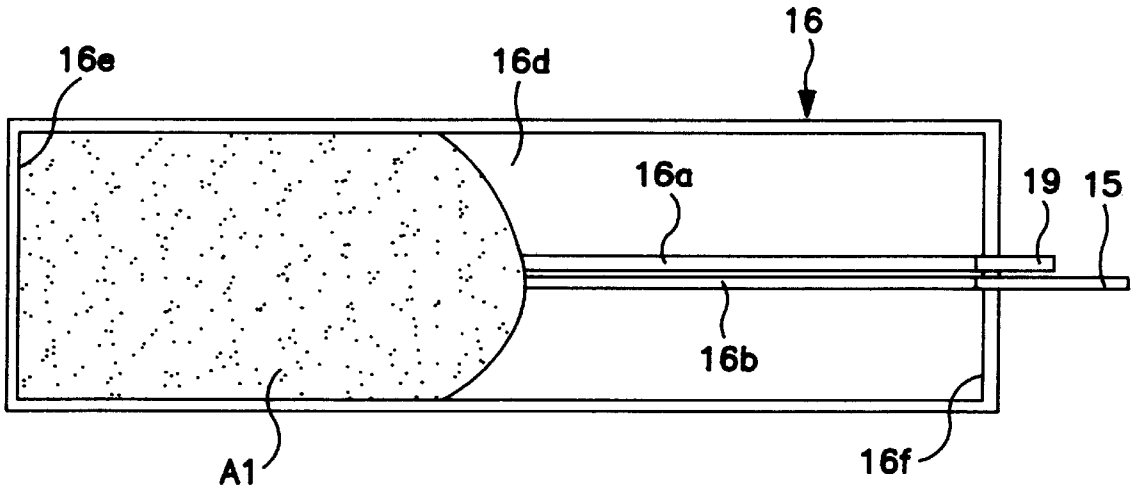
FIG. 6 is a schematic top view showing the waste liquid storing portion in accordance with the present invention at a stage where about half the total volume of the waste liquid is stored.

FIG. 5 and FIG. 6 show the manner in which the waste liquid is stored in the waste liquid storing portion 16 in accordance with this embodiment. Especially, FIG. 5 illustrates the initial stage of storage. On the other hand, FIG. 6 illustrates the stage where the waste liquid is stored up to about a half of the capacity or space of the waste liquid storing portion 16 when no waste liquid is stored therein. In FIG. 5, the waste ink and the waste treatment liquid which are transferred through the tubes 15 and 19, respectively, flows in the grooves 16*a* and 16*b*, respectively, and stored in the waste liquid storage portion 16. The two waste liquids remain in a fluid state since they do not mix with each other until they reach the tip portion 16*c*. When the both waste treatment liquid and waste ink has reached they mix with each other and the viscosity of the mixture increases. As a result, the waste liquids are stored in the form of an insoluble mass A as shown in FIG. 5. According as more waste liquids flow in, their mixture or insolubilized mass grows as indicated by Al in FIG. 6. In other words, the mass Al grows in the direction opposite to the direction in which the waste liquids are discharged.

In this state, the ink and the treatment liquid have already mixed with each other to have increased viscosity, thus forming a jelly-like reaction product. Accordingly, the waste liquids will not come out of the ink jet apparatus even when the body of the ink jet apparatus is tilted, thus giving the same effect as that obtained when a waste liquid absorbing substance is present in the waste liquid storing portion.

The balance between the quantity of waste treatment liquid and the quantity of waste ink varies depending on various factors such as humidity, temperature, printing frequency or the like. However, substantially the whole volume of the waste liquid storing portion 16 is available for storing waste liquids despite variations of the above-described factors since the position where the both liquids mix with each other or insolubilization of the waste liquids occurs is automatically regulated so that it moves gradually toward the right hand side end 16*f* starting from the left hand side end 16*e* even when the foregoing balance is largely deviated from the neutral state. In this occasion, an imbalance between the amounts of the both waste liquids means presence of a still-flowable waste liquid, which spreads or is distribute on the surface of the jelly-like reaction product having increased viscosity. The upper surface of the insolubilized mass extends according as the amounts of the waste liquids increase and, hence, more or less imbalances between the amounts of the waste liquids practically observed will cause no serious problem. Thus, the volume of the waste liquid storing portion 16 can be minimized, resulting in reduction of the fabrication cost. In addition, an increased efficiency of storing waste liquids permits providing an ink jet apparatus which has no need or less frequency of exchanging the waste liquid storing portion 16 with a fresh one.

In this embodiment, the waste liquid storing portion 16 is configured oblong, in a vertical cross section, with its longer sides extending in the horizontal direction. However, the waste liquid storing portion 16 may be of a vertically oblong type with its longer sides extending in the vertical direction so that the waste liquids are mixed with each other at the bottom of the waste liquid storing portion 16.

Figure 7:
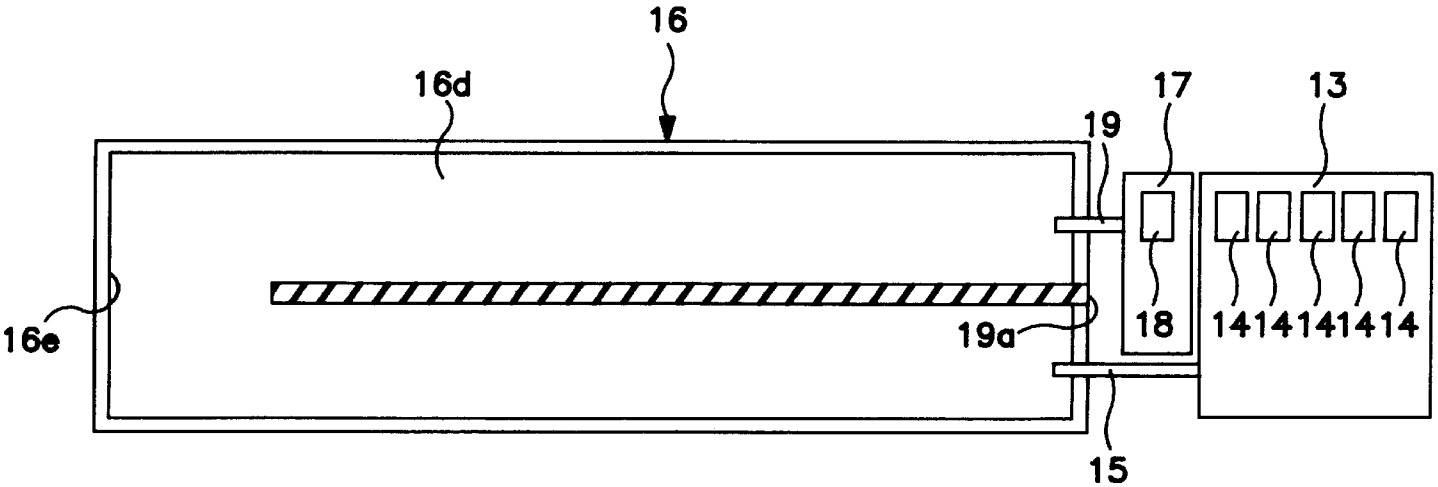
FIG. 7 is a schematic top view showing a waste liquid storing portion according to another embodiment of the present invention.

FIG. 7 is a schematic top view showing a waste liquid recovering and storing portion according to another embodiment of the present invention. In this embodiment, the waste liquid storing portion 16 is separated into two regions with a separator 19*a*. The inner bottom surface 16*d* of the waste liquid storing portion 16 is inclined with respect to a horizontal plane in the direction in which the waste liquids are discharged. The depth of the waste liquid storing portion 16 is greatest at the left end 16*e* of the waste liquid storing portion 16. The waste liquids flow toward the left end 16*e* due to gravitation and mix with each other near the left end 16*e* so that they adhere to the inner surface of the waste liquid storing portion 16 or the mixture of the waste liquids having increased viscosity or insolubilized. Thus, the waste liquids are stored in the waste liquid storing portion 16.

Figure 8:
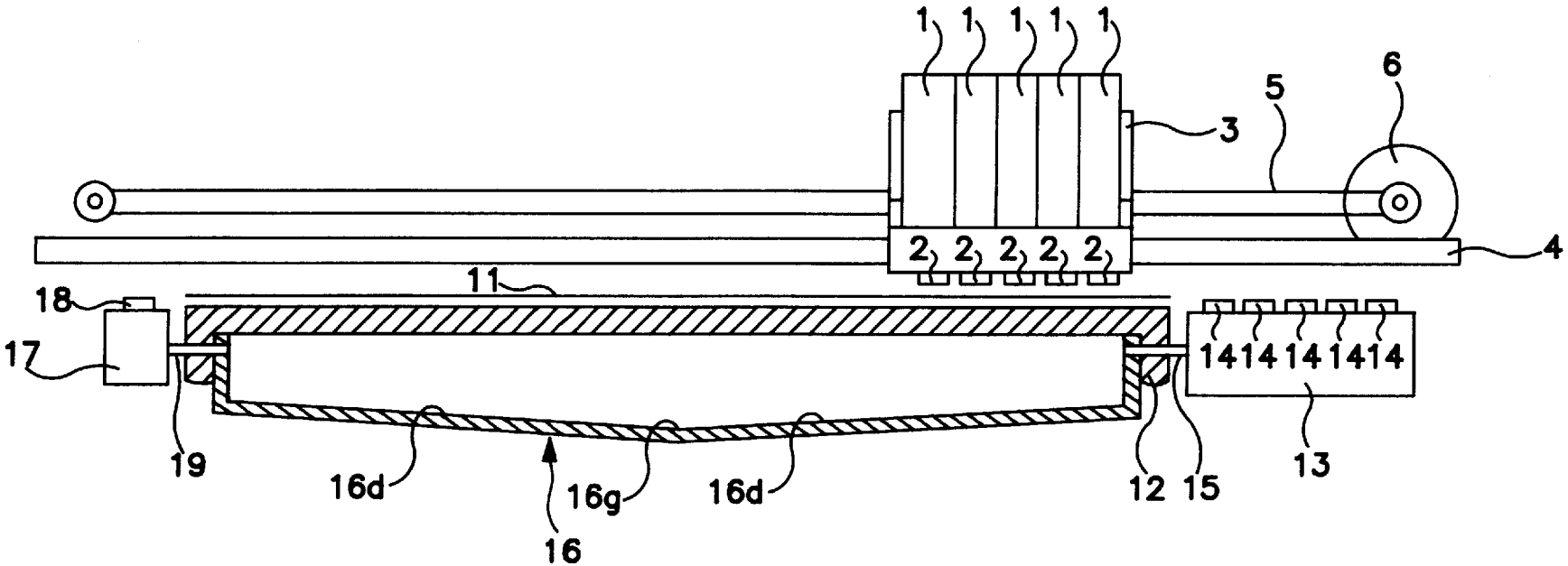
FIG. 8 is a schematic front view showing a main part of an ink jet printing apparatus according to still another embodiment of the present invention.

FIG. 8 is a schematic front view showing main parts of an ink jet apparatus according to still another embodiment of the present invention. In this embodiment, the recovering unit 17 for recovering treating liquid head is positioned on the side opposite to the side where the recovering unit 13 for recovering ink heads relative to the recording region. That is the recording region intervenes the both recovering units 13 and 17. The inner bottom surface 16*d* of the of the waste liquid storing portion 16 is inclined toward its central part 16*g* at which the waste liquid storing portion 16 is deepest. The waste liquids flow down due to gravitation on the inner bottom surface or on the mass which accumulated thereon toward the central part 16*g* and mix with each other therearound to form a jelly-like reaction product which has increased viscosity or becomes insolubilized. The waste liquids adhere to the inner surface of the waste liquid storing portion 16 or the mixture of the waste liquids having increased viscosity or insolubilized. Thus, the waste liquids are stored in the waste liquid storing portion 16.

With the above-described configuration, waste ink can be stored inside the body of the ink jet apparatus which uses treatment liquid and ink in a simple manner and at low cost so that production of high quality images and cost reduction and down sizing of the ink jet apparatus can be realized simultaneously.

Each head and each tank corresponding thereto may be produced by one-piece molding or may be of a construction such that one is detachably attached to the other. In the latter case, only the tank for each coloring ink can be exchanged if desired, for example, when the ink or treatment liquid in the tank is short. Also, only the head can be exchanged, if desired.

Further, the tank which is used in the practice of the present invention may be of an integral type in which tanks for the treatment liquid F and ink Bk are integral o tanks for inks C, M, and Y are integral.

Ink may be injected by connecting an ink supply pipe to the ink tank to form a passage for introducing ink to the tank and injecting ink through the passage. Ink supply port in the ink tank may be a supply port to be connected to the ejecting portion, an air communication port, or a bore formed in the wall of the ink tank.

The term "improvement of printability" as referred to herein with respect to the printability improving liquid, an example of which will be described hereinbelow, includes improvement in image quality such as density, color saturation, degree of sharpness at edge portion, and dot diameter, improvement in fixability of ink, and improvement in weatherability or image stability such as water resistance and light fastness, as will be described hereinbelow as an example.

The printability improving liquid, which is colorless or has a pale color, can be obtained, for example, as follows.

That is, after the following components are mixed and dissolved, the mixture is filtered under pressure through a membrane filter having a pore size of 0.22 $\mu$m (trade name: Flow Pore Filter, manufactured by Sumitomo Electric Industries, Ltd.) and then is adjusted with NaOH to pH 4.8 to obtain Solution A1. Composition of Solution A1:

[Components of A1]

Low molecular weight ingredients of cationic compound

| | |
|---|---|
| Stearyl-trimethylammonium salt (trade name: Electrostripper QE, manufactured by Kao Co.) | 2.0% |

High molecular weight ingredients of cationic compound

| | |
|---|---|
| Copolymer of diallylamine hydrochloride and sulfur dioxide (having an average molecular weight of 5000) (trade name: PAS-92, manufactured by Nitto Boseki Co.) | 3.0% |
| Thiodiglycol | 1.0% |
| Water | balance |

In the above-described colorless liquid A1, stearyl trimethylanonium chloride (trade name: Utamine 86P, manufactured by Kao Co.) may be used in place of stearyltrimethylammonium chloride (2.0%).

Preferable examples of ink which becomes insoluble by mixing the aforementioned colorless liquid can be noted below.

Specifically, the following components are mixed together, the resultant mixture is pressure-filtered with the use of a membrane filter of 0.22 $\mu$m in pore size (trade name:Chloroporefilter, manufactured by Sumitomo Denki Kogyo Co.) so that yellow ink Y1, magenta ink M1, cyan ink C1 and black ink K1 can be obtained.

Y1

| | |
|---|---|
| C. I. direct yellow 142 | 2% |
| thiodiglycol | 10% |
| acetynol EH (manufactured by Kawaken Fine chemical Co.) | 0.05% |
| water | balance |

M1 having the same composition as that of Y1 other than that the dyestuff is changed to 2.5% of C. I. acid red 289.

C1 having the same composition as that of Y1 other than that the dyestuff is changed to 2.5% of acid blue 9.

K1 having the same composition as that of Y1 other than that the dyestuff is changed to 3% of C. I. food black 2.

According to the present invention, the aforementioned colorless liquid and ink are mixed with each other at the position on the printing medium or at the position where they penetrate in the printing medium. As a result, the ingredient having a low molecular weight among the cationic material contained in the colorless liquid and the water soluble dye used in the ink having anionic radical are associated with each other by an ionic mutual function as a first stage of reaction whereby they are instantaneously separated from the solution liquid phase. As a result, there occurs in pigment ink destruction of dispersion so that agglomerates of pigment are formed.

Next, since the associated material of the dyestuff and the cationic material having a low molecular weight are adsorbed by the ingredient having a high molecular weight and contained in the colorless liquid as a second stage of reaction, a size of the aggregated material of the dyestuff caused by the association is further increased, causing the aggregated material to hardly enter fibers of the printed material. As a result, only the liquid portion separated from the solid portion permeates into the printed paper, whereby both high print quality and a quick fixing property are obtained. At the same time, the aggregated material formed by the ingredient having a low molecular weight of the cationic material caused by way of the aforementioned mechanism, the anionic dye and the cationic material has increased viscosity. Thus, since the aggregated material does not move as the liquid medium moves, ink dots adjacent to each other are formed by inks each having a different color like at the time of forming a full colored image but they are not mixed with each other. Consequently, a malfunction such as bleeding does not occur. Furthermore, since the aggregated material is substantially water-insoluble, water resistibility of a formed image is complete. In addition, light resistibility of the formed image can be improved by the shielding effect of polymer.

Insolubilization and/or agglomeration used in the present invention, an example thereof is a phenomenon involving only the above-described first stage of reaction and another example thereof is a phenomenon which involves the both first and second stages of reaction.

When the present invention is carried out, since there is no need of using the cationic material having a high molecular weight and polyvalent metallic salts like the prior art or even though there is need of using them, it is sufficient that they are assistantly used to improve an effect of the present invention, a quantity of usage of them can be minimized. As a result, the fact that there is no reduction of a property of color exhibition that is a problem in the case that an effect of water resistibility is asked for by using the conventional cationic high molecular weight material and the polyvalent metallic salts can be noted as another effect of the present invention.

With respect to a printing medium usable for carrying out the present invention, there is no specific restriction, so called plain paper such as copying paper, bond paper or the like conventionally used can preferably be used. Of course, coated paper specially prepared for ink Jet printing and OHP transparent film are preferably used. In addition, ordinary high quality paper and bright coated paper can preferably be used.

In the practice of the present invention, the coloring materials to be used are not limited to dyestuffs. It is also possible to use a mixture of a dyestuff and a pigment.

Ink usable for carrying out the present invention should not be limited only to dyestuff ink, and pigment ink having pigment dispersed therein can also be used. Any type of treatment liquid can be used, provided that pigment is aggregated with it. The following pigment ink can be noted as an example of pigment ink adapted to cause aggregation by mixing with the colorless liquid A1. As mentioned below, yellow ink Y2, magenta ink M2, cyan ink C2 and black ink K2 each containing pigment and anionic compound can be obtained.

[Black ink K2]

The following materials are poured in a batch type vertical sand mill (manufactured by Aimex Co.), glass beads each having a diameter of 1 mm is filled as media using anion based high molecular weight material P-1 (aqueous solution containing a solid ingredient of styrene methacrylic acid ethyl acrylate of 20% having an acid value of 400 and average molecular weight of 6000, neutralizing agent : potassium hydroxide) as dispersing agent to conduct dispersion treatment for 3 hours while water cooling the sand mill. After completion of dispersion, the resultant mixture has a viscosity of 9 cps and pH of 10.0. The dispersing liquid is poured in a centrifugal separator to remove coarse particles, and carbon black dispersing element having an average grain size is 10 nm is produced.

(Composition of carbon black dispersing element)

| | |
|---|---|
| P-1 aqueous solution (solid ingredient of 20%) | 40 parts |
| carbon black (Mogul L; manufactured by Cablack Co.) | 24 parts |
| glycerol | 15 parts |
| ethylene glycol monobutyl ether | 0.5 parts |
| isopropyl alcohol | 3 parts |
| water | 135 parts |

Next, the thus obtained dispersing element is sufficiently dispersed in water, and black ink K2 containing pigment for ink jet printing is obtained. The final product has a solid ingredient of about 10%

[Yellow ink Y2]

Anionic high molecular P-2 (aqueous solution containing a solid ingredient of 20% of styrene acrylic acid methyl methacrylate having an acid value of 280 and an average molecular weight of 11,000, neutralizing agent:diethanolamine) is used as a dispersing agent and dispersive treatment is conducted in the same manner as production of the black ink K2 whereby yellow color dispersing element having an average granular diameter 103 nm is produced.

(composition of yellow dispersant)

| | |
|---|---|
| P-2 aqueous solution (having a solid ingredient of 20%) | 35 parts |
| C. I. pigment yellow 180 (trade name: Nobapalm yellow-PH-G, manufactured by Hext Co.) | 24 parts |
| triethylene glycol | 10 parts |
| diethylene glycol | 10 parts |
| ethylene glycol monobutyl ether | 1.0 parts |
| isopropyl alcohol | 0.5 parts |
| water | 135 parts |

The thus obtained yellow dispersing element is sufficiently dispersed in water to obtain yellow ink Y2 for ink jet printing and having pigment contained therein. The final product of ink contains a solid ingredient of about 10%.

[Cyan ink C2]

Cyan colored-dispersant element having an average grain size of 120 m is produced using anionic high molecular P-1 as dispersing agent, and moreover, using the following materials by conducting dispersing treatment in the same manner as the carbon black dispersing element.

(composition of cyan colored-dispersing element)

| | |
|---|---|
| P-1 aqueous solution (having solid ingredient of 20%) | 30 parts |
| C. I. pigment blue 15:3 (trade name: Fastogen blue FGF, manufactured by Dainippon Ink Kagaku Kogyo Co.) | 24 parts |
| glycerol | 15 parts |
| diethylene glycol monobutyl ether | 0.5 parts |
| isopropyl alcohol | 3 parts |
| water | 135 parts |

The thus obtained cyan colored dispersing element is sufficiently stirred to obtain cyan ink C2 for ink jet printing and having pigment contained therein. The final product of ink has a solid ingredient of about 9.6%.

[Magenta ink M2}

Magenta color dispersing element having an average grain size of 115 nm is produced by using the anionic high molecular P-1 used when producing the black ink K2 as dispersing agent, and moreover, using the following materials in the same manner as that in the case of the carbon black dispersing agent.

(composition of the magenta colored dispersing element)

| | |
|---|---|
| P-1 aqueous solution (having a solid ingredient of 20%) | 20 parts |
| C. I. pigment red 122 (manufactured by Dainippon Ink Kagaku Kogyo Co.) | 24 parts |
| glycerol | 15 parts |
| isopropyl alcohol | 3 parts |
| water | 135 parts |

Magenta ink M2 for ink jet printing and having pigment contained therein is obtained by sufficiently dispersing the magenta colored dispersing element in water. The final product of ink has a solid ingredient of about 9.2%.

Figure 9:
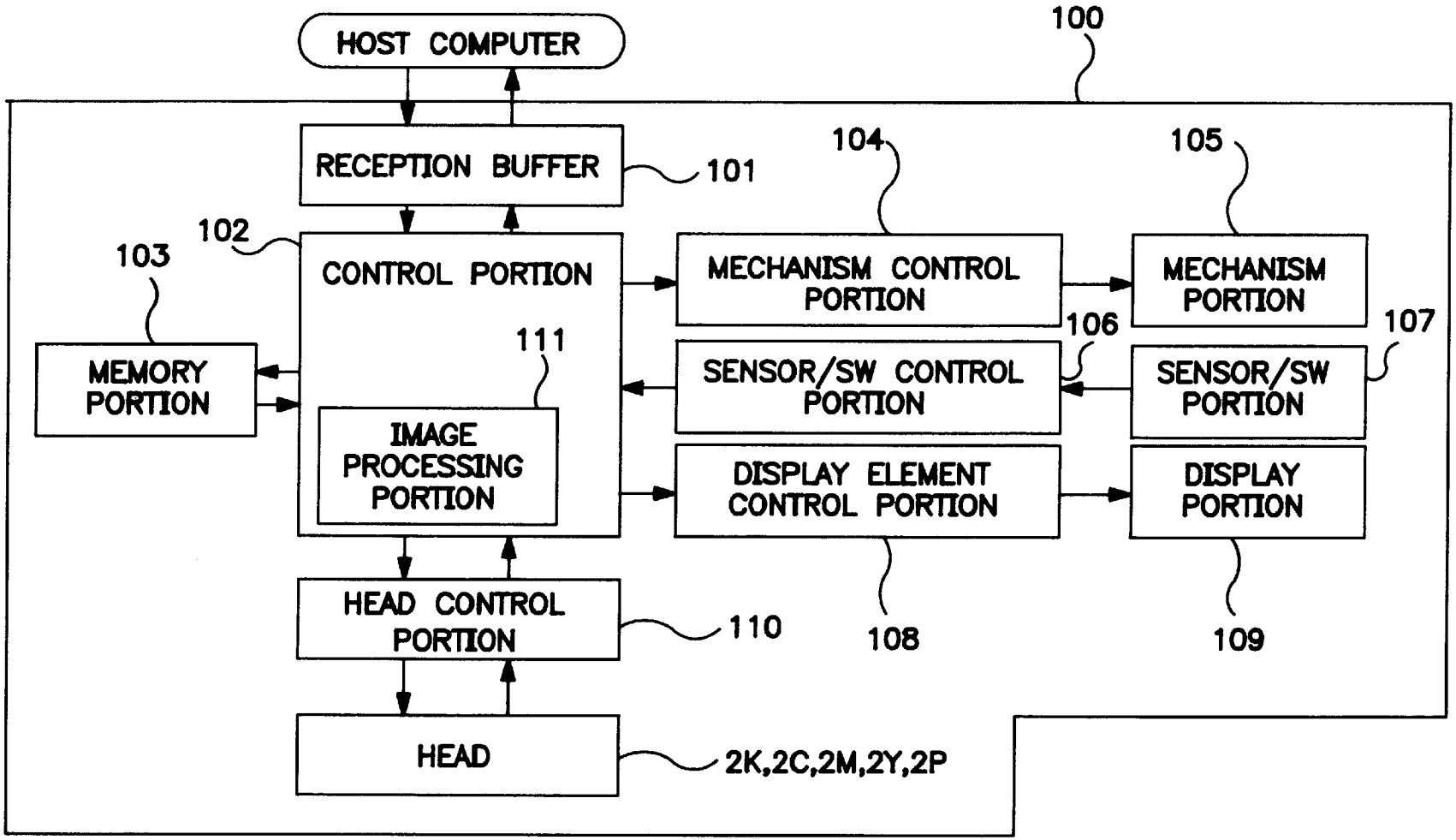
FIG. 9 is a block diagram showing control mechanism for controlling the ink jet printing apparatus in accordance with an example of the present invention.

FIG. 9 is a block diagram showing an information processing system using an ink jet printing apparatus of the present invention. Data of characters or image to be printed (hereafter, referred to as image data) are inputted form a host computer to a receiving buffer 1401 of an ink jet printing apparatus 100. Data for confirming if the data are transmitted correctly and data on conditions of operation of the printing apparatus are transmitted from the printing apparatus to the host computer. The data inputted to the receiving buffer 101 are transmitted to a memory portion 103 in the form of RAM under control of a control portion 102, and temporarily stored in the memory portion.

A mechanism control portion 104, under command from the control portion 102, drives a mechanism portion 105 such as carriage motor or line feed motor as a driving force source for operating a carriage 101, a driving belt 104, conveying rolls 106 to 109 (FIG. 2). A sensor/SW control portion 106 transmits signals from a sensor/SW portion 107 including various sensors and SW (switches) to the control portion 102. A display device control portion 108, under command from the control portion 102, controls display of a display device 109 such as LED of display panels or liquid crystal display device. A head control portion 110, under command from the control portion 102, controls the heads 102K, 102C, 102M, 102Y, and 102S independently, and reads information on the conditions of the heads such as temperature and transmits the data to the control portion 102.

The control portion 102 is provided with an image processing portion 111 fro performing image processing described hereinbelow.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. As examples of the recovery system, are a capping means and a cleaning means for the recording head, and a pressure or suction means for the recording head. As examples of the preliminary auxiliary system, are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

Figure 10:
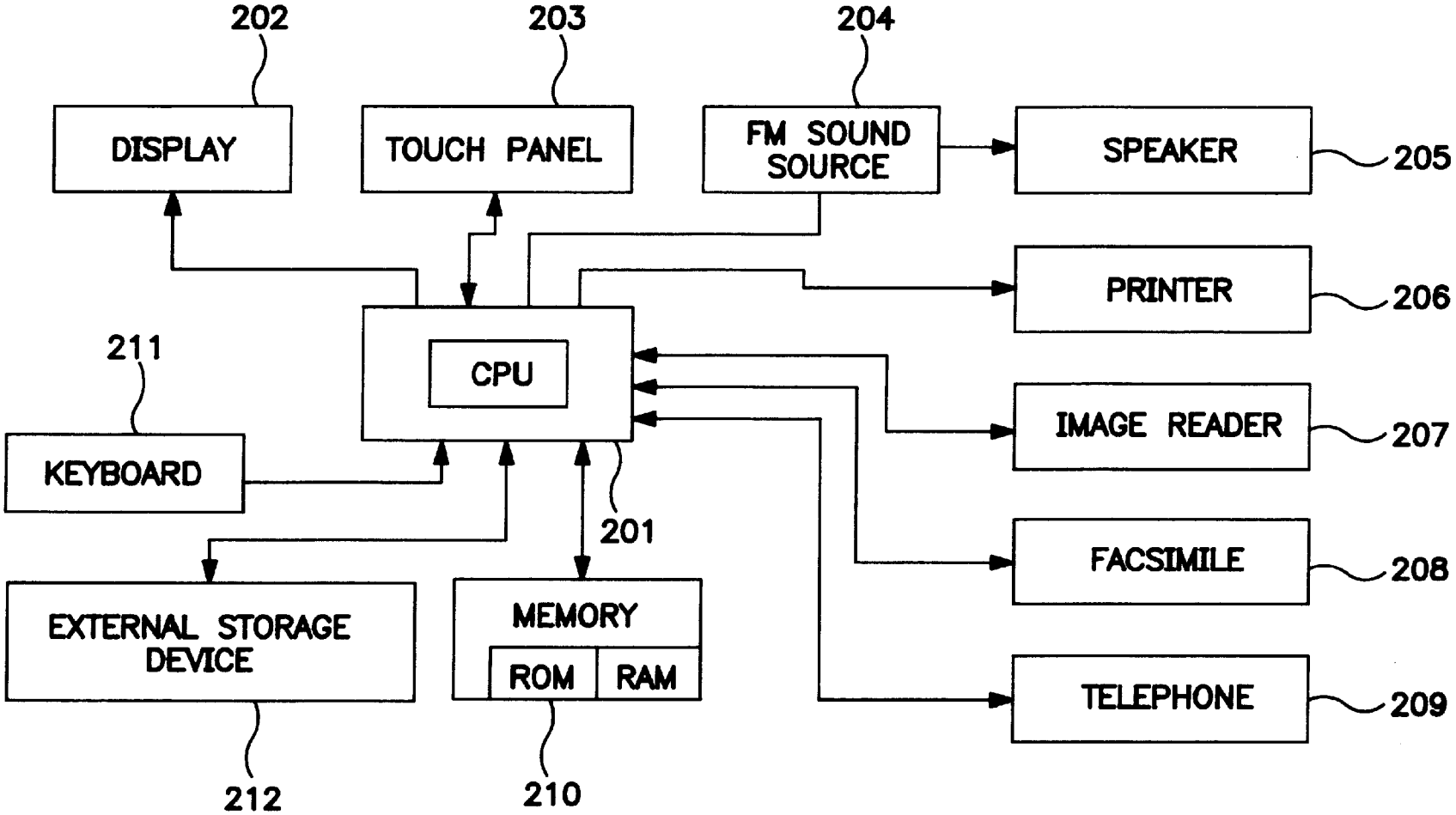
FIG. 10 is a block diagram showing an example of an information processing system using an ink jet printing apparatus of the present invention.

FIG. 10 is a block diagram showing general construction of an information processing apparatus having a function of word processor, personal computer, facsimile machine, a copy machine and so forth, to which the printing apparatus according to the present invention is applied.

In the drawings, a reference numeral 201 denotes a control part performing control of the overall apparatus, which includes CPU, such as microprocessor and so forth, and various I/O port, to perform control for outputting control signal or data signal and so forth to respective parts and inputting control signal or data signal from the respective parts. A reference numeral 202 denotes a display part having a display screen, on which various menu, document information and image or so forth read by an image reader 207 are displayed. A reference numeral 203 denotes a transparent pressure sensitive touch panel provided on the display part 202 for performing item entry or coordinate part entry on the display part 202 by depressing the surface thereof by a finger or so forth.

A reference numeral 204 denotes a FM (frequency modulation) sound source part which stores music information produced by a music editor and so forth in a memory part 210 or an external memory 212 and performs FM modulation by reading out the stored music information from the memory part or so forth. An electric signal from the FM sound source part 204 is transformed into an audible sound by a speaker part 205. A printer part 206 is employed as an output terminal of the word processor, the personal computer, the facsimile machine, the copy machine and so forth, in which the printing apparatus according to the present invention is applied.

A reference numeral 207 denotes an image reader part for optoelectrically read out an original data for inputting, which is located at the intermediate position in an original feeding path and performs reading out various original document, such as original document for facsimile machine or copy machine. A reference numeral 208 denotes a facsimile (FAX) transmission and reception part for transmitting original data read by the image reader part or for receiving transmitted facsimile signal, which facsimile transmission and reception part has an external interface function. A reference numeral 209 denotes a telephone machine part having a normal telephone function and various associated functions, such as a recording telephone and so forth.

A reference numeral 210 denotes a memory part including a ROM storing a system program, a manager program, other application program and so forth, as well as character fonts, dictionary and so forth, a RAM for storing application program loaded from an external storage device 212, document information, video information and so forth.

A reference numeral 211 denotes a keyboard part inputting document information or various commands. A reference numeral 212 denotes the external storage device employing a floppy disc or hard disc drive as storage medium. In the external storage device 212, document information, music or speech information, application program of the user and so forth are stored.

Figure 11:
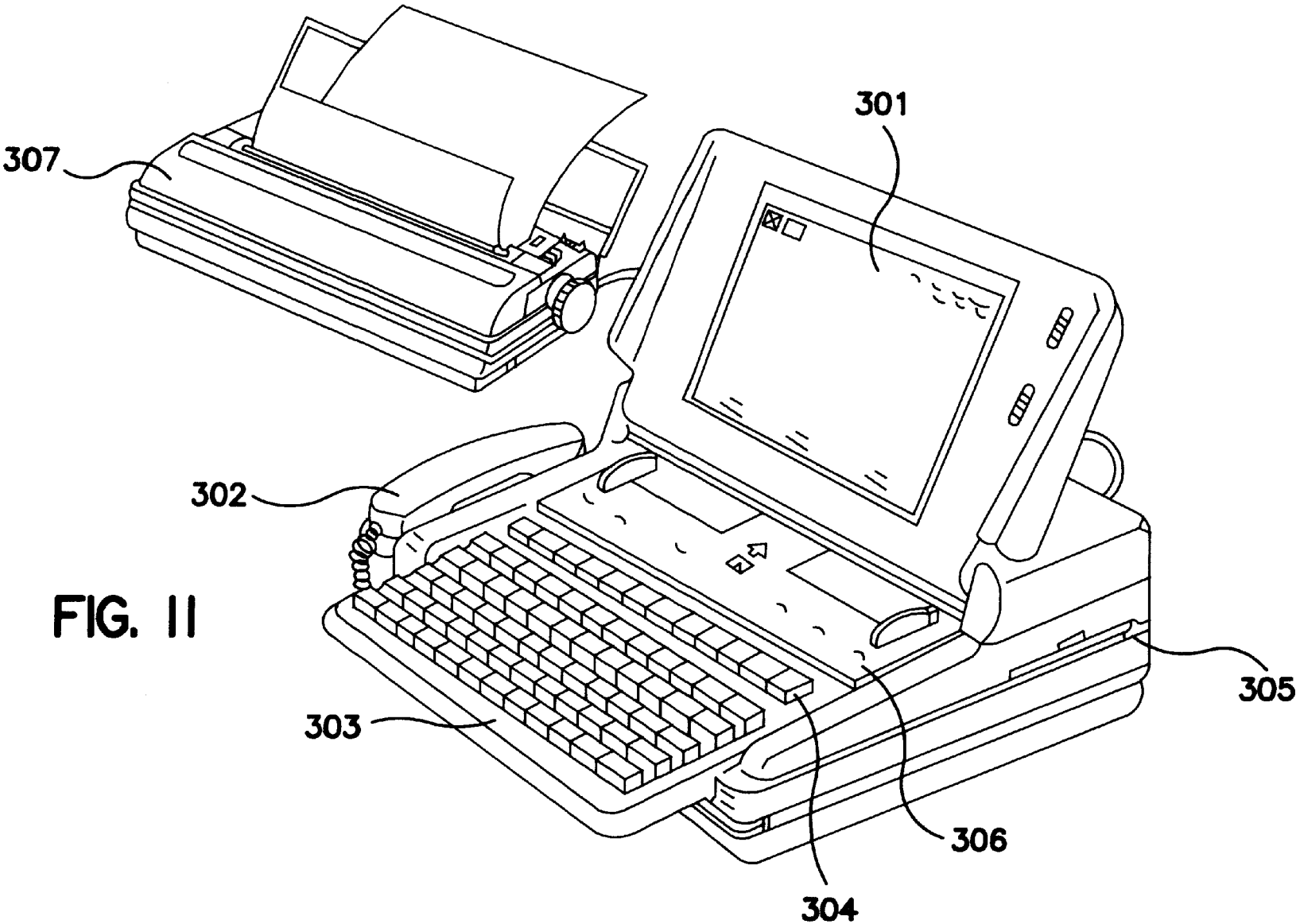
FIG. 11 is a schematic perspective view showing an appearance of the information processing system shown in FIG. 10.

FIG. 11 is a diagrammatic external view of the information processing system shown in FIG. 10.

In FIG. 11, a reference numeral 301 denotes a flat panel display utilizing a liquid crystal and so forth. On this display the touch panel 203 is overlaid so that coordinate position input or item designation input can be performed by depressing the surface of the touch panel 203 by a finger or so forth. A reference numeral 302 denotes a handset to be used when a function as the telephone machine of the apparatus is used. A keyboard is detachably connected to a main body of the apparatus through a cable and adapted to permit entry of various document information or various data input. On the other hand, on the keyboard 403, various function keys and so forth are arranged. A reference numeral 405 denotes an insertion mouth of the external storage device 212 for accommodating a floppy disk inserted thereinto.

A reference numeral 406 denotes a paper stacking part for stacking the original to be read by the image reader part 207. The original read by the image reader part is discharged from the back part of the apparatus. On the other hand, in facsimile reception, the received information is printed by the ink-jet printer 407.

It should be noted that while the display part 202 may be a CRT, it is desirable to employ a flat display panel, such as a liquid crystal display employing a ferrodielectric liquid crystal for capability of downsizing and reduction of thickness as well as reduction of weight.

When the information processing apparatus as set forth apparatus is operated as the personal computer or the word processor, various information input through the keyboard part 211 is processed according to a predetermined program by the control part 201 and output as printed image by the printer part 206.

When the information processing apparatus is operated as a receiver of the facsimile machine, facsimile information input from the FAX transmission and reception part 208 via a communication network is subject reception process according to the predetermined program and output as received image by the printer part 208.

In addition, when the information processing apparatus is operated as a copy machine, the original is read by the image reader part 207 and the read original data is output to the printer part as copy image via the control part 201. It should be noted that, when the information processing apparatus is used as the transmitter of the facsimile machine, the original data read by the image reader 207 is processed for transmission according to the predetermined program by the control part, and thereafter transmitted to the communication network via the FAX transmission and reception part 208.

Figure 12:
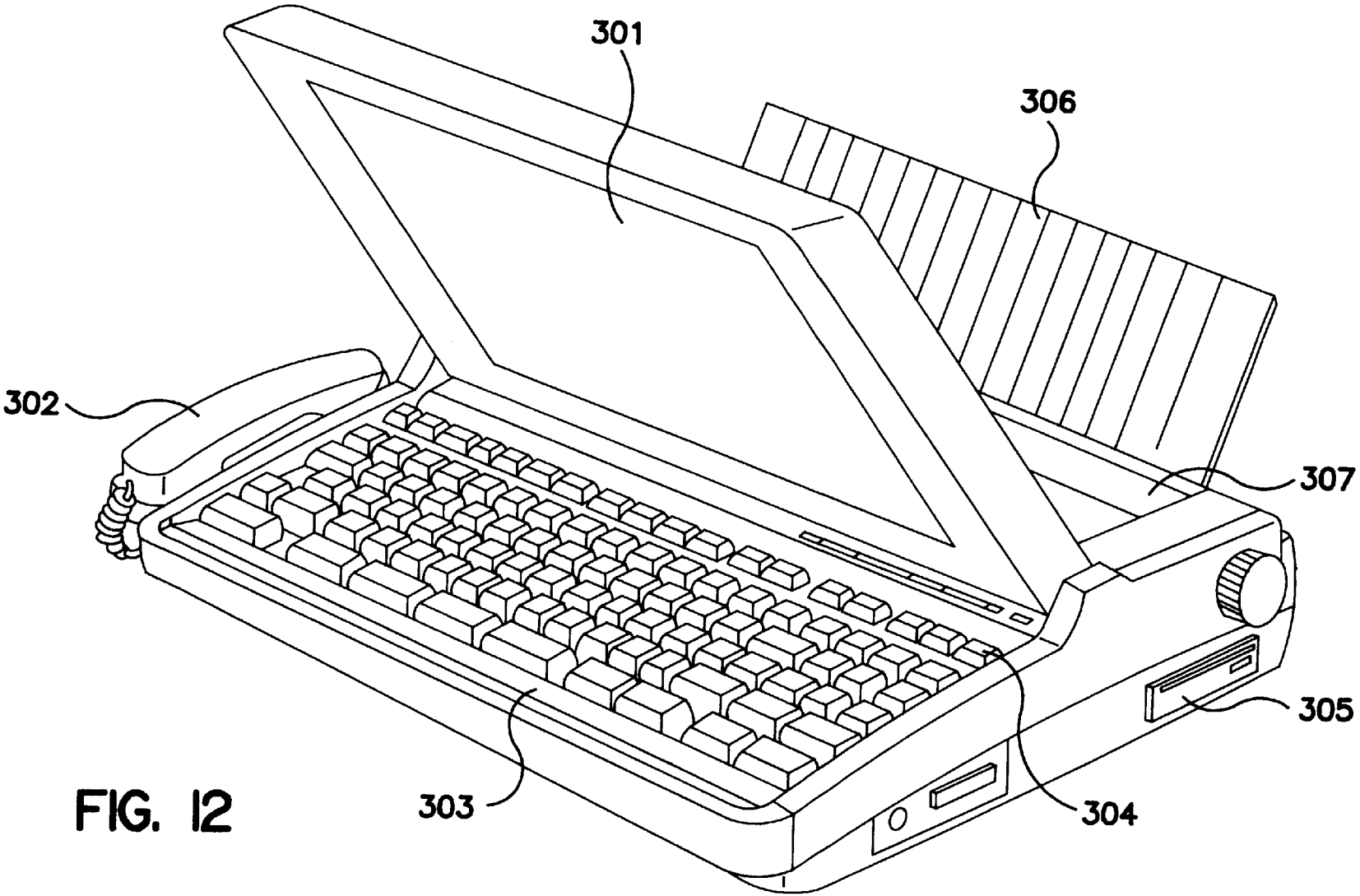
FIG. 12 is a schematic perspective view showing another example of information processing system using an ink jet printing apparatus of the present invention.

It should be noted that the information processing apparatus may be an integrated type incorporating the ink-jet printer within a main body as illustrated in FIG. 12. In this case, portability can be further improved. In FIG. 12, the parts having the same function to FIG. 11 are shown with the corresponding reference numerals.

As set forth above, a multi-function type information processing apparatus may obtain high quality printed image at high speed and low noise by employing the printing apparatus of the present invention. Therefore, the functions of the information processing apparatus can be further enhanced.

The present invention has been described in detail with respect to preferred embodiments, and it will be now be that changes and modifications may be made without departing from the invention in its broader aspects, and it is the intention, therefore, in the appended claims to cover all such changes and modifications as fall within the true spirit of the invention.

What is claimed is:

1. An ink jet apparatus comprising:

a first ejecting portion for ejecting a treatment liquid having a function of insolubilizing or agglomerating the ink;

a second ejecting portion for ejecting an ink;

first recovering means for recovering nozzles of said first ejecting portion;

second recovering means for recovering nozzles of said second ejecting portion;

waste liquid storing means for storing waste liquids discharged from said first and second recovering means;

first transfer means for transferring said waste liquid discharged from said first recovering means to said waste liquid storing means, said first transfer means having a discharge end for discharging said waste liquid from said first recovering means;

second transfer means for transferring said waste liquid discharged from said second recovering means to said waste liquid storing means, said first transfer means having a discharge end for discharging said waste liquid from said second recovering means;

wherein said waste liquid storing means has an inner bottom surface, said inner bottom surface arranged descending in vertical direction from a position in which said discharge ends of said first and second waste liquid transferring means, respectively, are located toward positions remote from said position in which said discharge ends are located.

2. The ink jet apparatus as claimed in claim 1, wherein said second ejecting portion comprises a plurality of ejecting portions.

3. The ink jet apparatus as claimed in claim 1, further comprising means for generating thermal energy for ejecting an ink or treatment liquid.

4. The ink jet apparatus as claimed in claim 1, wherein said treatment liquid contains a cationic material composed of a low molecular weight ingredient and a high molecular weight ingredient, and said ink contains an anionic dye.

5. The ink jet apparatus as claimed in claim 1, wherein said treatment liquid contains a cationic material composed of a low molecular weight ingredient and a high molecular weight ingredient, and said ink contains an anionic dye or at least an anionic compound and a pigment.

6. An ink jet apparatus comprising:

a first ejecting portion for ejecting a treatment liquid having a function of insolubilizing or agglomerating an ink;

a second ejecting portion for ejecting the ink;

a framework for storing therein a waste liquid of said treatment liquid and a waste liquid of said ink;

a cap for sucking said first ejecting portion, said cap contacting said first ejecting portion;

a first suction pump for sucking a liquid in said first ejecting portion through said cap for sucking said first ejecting portion;

a first tube for introducing said waste liquid discharged from said first suction pump to said framework for storing said waste liquid discharged from said first suction pump;

a first groove for flowing said waste liquid discharged from said first tube;

a cap for sucking said second ejecting portion, said cap contacting said second ejecting portion;

a second suction pump for sucking a liquid in said second ejecting portion through said cap for sucking said second ejecting portion;

a second tube for introducing said waste liquid discharged from said second suction pump to said framework for storing said waste liquid discharged from said second suction pump;

a second groove for flowing said waste liquid discharged from said second tube;

wherein said waste liquid storing framework has a bottom surface being inclined in the direction in which waste liquid is discharged, said first and second grooves being arranged in said bottom surface of said waste liquid storing framework parallel to each other in a juxtaposed state, said first and second grooves having respective ends joining with each other.

7. The ink jet apparatus as claimed in claim 6, wherein said second ejecting portion comprises a plurality of ejecting portions.

8. The ink jet apparatus as claimed in claim 6, wherein said ink jet head includes as an energy generating element an eletrothermal transducer for generating thermal energy so as to allow a phenomenon of film boiling to appear in ink.

9. The ink jet apparatus as claimed in claim 6, wherein said treatment liquid contains a cationic material composed of a low molecular weight ingredient and a high molecular weight ingredient, and said ink contains an anionic dye.

10. The ink jet apparatus as claimed in claim 6, wherein said treatment liquid contains a cationic material composed of a low molecular weight ingredient and a high molecular weight ingredient, and said ink contains an anionic dye or at least an anionic compound and a pigment.

11. A method of disposing of a waste liquid in an ink jet apparatus, comprising the steps of:

recovering a first ejecting portion for ejecting a treatment liquid having a function of insolubilizing or agglomerating an ink;

recovering a second ejecting portion for ejecting said ink;

transferring waste liquids discharged from said first and second ejecting portions, respectively, upon said recovering, in an isolated state to a predetermined position in a waste liquid storing region due to gravitation; and mixing said waste liquids of said ink and said treatment liquid in said predetermined position in said waste liquid storing region to insolubilize or agglomerate them.

12. The method as claimed in claim 11, wherein said second ejecting portion comprises a plurality of ejecting portions.

13. A method of disposing of a waste liquid in an ink jet apparatus, comprising the steps of:

contacting caps with a first ejecting portion for ejecting a treatment liquid having a function of insolubilizing or agglomerating an ink and with a second ejecting portion for ejecting said ink, and then sucking said first and second ejecting portions by means of first and second suction pumps, respectively;

transferring waste liquids discharged from said first and second ejecting portions, respectively, to a predetermined position in a waste liquid storing region by means of first and second tube means, respectively; and flowing said waste liquids of said ink and said treatment liquid discharged from said first and second tube means, respectively, in respective passages substantially parallel to each other in a juxtaposed state along a plane inclined with respect to the direction in which said waste liquids are discharged, and allowing said waste liquids to join at ends of said passages to thereby mix said waste liquids of said treatment liquid and said ink to insolubilize or agglomerate said waste liquids.

14. The method as claimed in claim 13, wherein said second ejecting portion comprises a plurality of ejecting portions.

15. A method of disposing of waste liquids in an ink jet apparatus including a first ejecting portion for ejecting a treatment liquid having a function of insolubilizing or agglomerating an ink and a second ejecting portion for ejecting said ink, comprising the steps of:

transferring respective waste liquids discharged from said first and second ejecting portions to predetermined position in a waste liquid storing region in an isolated state due to gravitation; and mixing said waste liquid of said treatment liquid and said waste liquid of said ink in said predetermined position in said waste liquid storing region to insolubilize or agglomerate said waste liquids.

16. The method as claimed in claim 15, wherein said second ejecting portion comprises a plurality of ejecting portions.

17. A method of disposing of waste liquids in an ink jet apparatus including a first ejecting portion for ejecting a treatment liquid having a function of insolubilizing or agglomerating an ink and a second ejecting portion for ejecting said ink, comprising the steps of:

transferring respective waste liquids discharged from said first and second ejecting portions to a waste liquid storing region by means of first and second tubes; and flowing said waste liquids of said ink and said treatment liquid discharged from said first and second tube means, respectively, in respective passages substantially parallel to each other in a juxtaposed state along a plane inclined with respect to the direction in which said waste liquids are discharged, and allowing said waste liquids to join at ends of said passages to thereby mix said waste liquids of said treatment liquid and said ink to insolubilize or agglomerate said waste liquids.

18. The method as claimed in claim 17, wherein said second ejecting portion comprises a plurality of ejecting portions.

19. A container for storing waste liquids from an ink jet apparatus including a first ejecting portion for ejecting a treatment liquid having a function of insolubilizing or agglomerating an ink and a second ejecting portion for ejecting said ink, said container comprising:

storing space for storing waste liquids from said first and second ejecting portions upon recovery thereof;

a first transferring passage for transferring said waste liquid of said treatment liquid into said storing space; and a second transferring passage for transferring said waste liquid of said ink into said storing space, wherein said storing space is defined by an inner bottom surface, said inner bottom surface arranged descending in vertical direction from a position in which said discharge ends of said first and second waste liquid transferring passages, respectively, are located toward positions remote from said position in which said discharge ends are located.

20. A container for storing waste liquids from an ink jet apparatus including a first ejecting portion for ejecting a treatment liquid having a function of insolubilizing or agglomerating an ink and a second ejecting portion for ejecting said ink, said container comprising:

a framework for storing space for storing waste liquids of said treatment liquid and said ink, respectively;

a first groove for flowing said waste liquid of said treatment liquid; and a second groove for flowing said waste liquid of said ink;

wherein said framework has an inner bottom surface, said inner bottom surface arranged inclined in the direction in which said waste liquids are discharged, and said first and second grooves are arranged in said inner bottom surface parallel to each other and in a juxtaposed state, with said ends of said first and second grooves joining with each other.

21. An apparatus for disposing of waste liquids from an ink jet apparatus including a first ejecting portion for ejecting a treatment liquid having a function of insolubilizing or agglomerating an ink and a second ejecting portion for ejecting said ink, said apparatus comprising:

waste liquid storing means for storing waste liquids of said ink and said treatment liquid, respectively;

first transferring means for transferring said waste liquid of said treatment liquid to said waste liquid storing means; and second transferring means for transferring said waste liquid of said ink to said waste liquid storing means;

wherein said waste liquid storing means has an inner bottom surface, said inner bottom surface arranged inclined in the direction in which said waste liquids are discharged, and said first and second transferring means are arranged in said inner bottom surface parallel to each other and in a juxtaposed state, with said ends of said first and second transferring means joining with each other.

22. The apparatus as claimed in claim 21, wherein said second ejecting portion comprises a plurality of ejecting portions.

23. An apparatus for disposing of waste liquids from an ink jet apparatus including a first ejecting portion for ejecting a treatment liquid having a function of insolubilizing or agglomerating an ink and a second ejecting portion for ejecting said ink, said apparatus comprising:

a framework for staring waste liquids of said ink and said treatment liquid, respectively;

a first tube for transferring said waste liquid of said treatment liquid to said framework for storing waste liquids;

a first groove for flowing said waste liquid discharged from said first tube;

a second tube for transferring said waste liquid of said ink to said framework for storing waste liquids; and a second groove for flowing said waste liquid discharged from said second tube;

wherein said framework for storing waste liquids has an inner bottom surface, said inner bottom surface arranged inclined in the direction in which said waste liquids are discharged, and said first and second grooves are arranged in said inner bottom surface parallel to each other and in a juxtaposed state, with said ends of said first and second grooves joining with each other.

24. The apparatus as claimed in claim 23, wherein said second ejecting portion comprises a plurality of ejecting portions.

* * * * *

UNITED STATES PATENT AND TRADEMARK OFFICE

CERTIFICATE OF CORRECTION

PATENT NO. : 5,953,026

DATED : September 14, 1999

INVENTOR : HIROSHI YOSHINO

It is certified that error appears in the above-identified patent and that said Letters Patent is hereby corrected as shown below:

COLUMN 1

Line 36, "get together" should read --accumulates--.

Line 58, "adhere" should read --adheres--.

COLUMN 3

Line 3, "is" should read --are--.

Line 7, "faces" should read --face--.

Line 8, "comes" should read --it comes--.

Line 49, delete "of".

COLUMN 4

Line 5, "aid" should read --said--.

UNITED STATES PATENT AND TRADEMARK OFFICE

CERTIFICATE OF CORRECTION

PATENT NO. : 5,953,026

DATED : September 14, 1999

INVENTOR : HIROSHI YOSHINO

It is certified that error appears in the above-identified patent and that said Letters Patent is hereby corrected as shown below:

COLUMN 5

Line 9, "liquid-is" should read --liquid is--.

COLUMN 8

Line 39, "vet" should read --jet--.

COLUMN 9

Line 40, "head" should read --head.--.

COLUMN 10

Line 34, "flows" should read --flow--.

Line 38, "has" should read --have--.

COLUMN 11

Line 1, "distribute" should read --distributed--.

UNITED STATES PATENT AND TRADEMARK OFFICE

CERTIFICATE OF CORRECTION

PATENT NO. : 5,953,026

DATED : September 14, 1999

INVENTOR : HIROSHI YOSHINO

It is certified that error appears in the above-identified patent and that said Letters Patent is hereby corrected as shown below:

COLUMN 12

Line 3, "o" should read --to--.

Line 62, "chemical" should read --Chemical--.

COLUMN 13

Line 64, "Jet" should read --jet--.

COLUMN 14

Line 16, "is" should read --are--.

COLUMN 17

Line 22, "mixing" should read --mixing.--.

Line 62, "port," should read --ports,--.

UNITED STATES PATENT AND TRADEMARK OFFICE

CERTIFICATE OF CORRECTION

PATENT NO. : 5,953,026

DATED : September 14, 1999

INVENTOR : HIROSHI YOSHINO

It is certified that error appears in the above-identified patent and that said Letters Patent is hereby corrected as shown below:

COLUMN 18

Line 18, "read" should read --reading--.

Line 21, "document," should read --documents,--.

Line 52, "as" should read --such as--.

COLUMN 19

Line 5, delete "apparatus".

Signed and Sealed this

Thirty-first Day of October, 2000

*Attest:*

Q. TODD DICKINSON

*Attesting Officer*

*Director of Patents and Trademarks*